US006284960B1

(12) United States Patent
DaSilva et al.

(10) Patent No.: US 6,284,960 B1
(45) Date of Patent: Sep. 4, 2001

(54) WOODWIND INSTRUMENT REED MAINTENANCE DEVICE

(76) Inventors: Frank J. DaSilva, 4074 Sutton Ter., Orlando, FL (US) 32811; Joseph M. Ballaera, 23 S. Lake Ave., Apopka, FL (US) 32703

( * ) Notice: Subject to any disclaimer, the term of this patent is extended or adjusted under 35 U.S.C. 154(b) by 0 days.

(21) Appl. No.: 09/660,817

(22) Filed: Sep. 13, 2000

Related U.S. Application Data

(60) Provisional application No. 60/155,115, filed on Sep. 22, 1999.

(51) Int. Cl.[7] ..... G10G 7/00

(52) U.S. Cl. ..... 84/458; 84/453; 84/383 A

(58) Field of Search ..... 84/458, 453, 383 A, 84/363, 375

(56) References Cited

U.S. PATENT DOCUMENTS 555,962 * 3/1896 Meister ..... 144/146
2,110,050 * 3/1938 Miller ..... 30/229
3,389,630 * 6/1968 Browder ..... 84/458
4,231,404 * 11/1980 Van Doren et al. ..... 144/2.1
4,809,583 * 3/1989 Kume ..... 84/453

FOREIGN PATENT DOCUMENTS

2539538 * 7/1984 (FR) .

* cited by examiner

*Primary Examiner*—Shih-Yung Hsieh
(74) *Attorney, Agent, or Firm*—Terry M. Sanks, Esq.; David G. Maire, Esq.; Beusse, Brownlee, Bowdoin & Wolter, PA

(57) ABSTRACT

A woodwind instrument reed maintenance device that extends the life of a used reed by removing the tip of the reed by burning. The device achieves extended life, and a brighter or a more projected sound from a used reed due to the cauterization of the woody longitudinal fibers called vascular bundles, running vertically the entire length of the reed. The device holds the reed securely and is designed to retain the burned tip at the precise angles or arc of the cut of the tip so as to maintain a working relationship with the woodwind mouthpiece. In addition, the top portion utilizes an angled tip to not only secure the reed in the device, but to prevent back burn to playable areas of the reed surfaces.

9 Claims, 1 Drawing Sheet

WOODWIND INSTRUMENT REED MAINTENANCE DEVICE

The present invention claims the benefit of U.S. Provisional application Ser. No. 60/155,115 filed Sep. 22, 1999.

BACKGROUND OF THE INVENTION

The invention relates to the maintenance of woodwind instrument reeds, and more particularly to an apparatus and method for removing the worn part of a reed while maintaining the structural features of the reed to extend its life and achieve a brighter sound or more projected sound.

Most woodwind musicians claim that they find maybe two reeds out of a box that gives them the sound that they prefer based on the style of play they are used to. When those reeds start to wear, they're forced to go through another box to find that perfect reed again.

There are many variables in the way woodwind reeds are made, and there is an increasing demand for woodwind reeds worldwide. Since the reed tips are cut on a precise angle or arc, variances are mostly attributed to the quality of the cane itself.

The best cane is grown in the province of Var in southeastern France. The coastal region of Catalonia in eastern Spain is the world's second largest commercial producer of reed cane.

Reed cane is planted, grown, harvested, cured, selected for reed sizes and cut into reeds. About three years have elapsed by the time a woodwind player attaches a reed on a mouthpiece. And as standardized a system as it is, there are still variances in the quality of reeds. Even reeds manufactured under the best conditions of care and quality control cannot always be perfect.

Reed cane itself is a woody structure with longitudinal fibers, called vascular bundles, running its entire length. The vascular bundles are what gives a reed its strength and resiliency. With proper backlighting, they can be observed in the cut of the reed vamp (the top section of the reed from the score to the tip).

Reed material is made of mostly cellulose, which is what comprises the main part of the cell walls of plants. Saliva breaks down this cellulose, which is a complex carbohydrate or starch, into glucose, which is sugar. During play, saliva enters these tube-like reed fibers. Initially, this interaction is beneficial. The saliva causes the fibers to become more flexible and less porous.

Reeds must be able to handle a great deal of stress to allow a musician to play with the sound and control that a professional must possess. One part of a reed is a vamp which has a tapered thickness where the tip of the reed that interacts with a player's tongue is the thinnest part. The tip has a unique curvilinear shape specific to each woodwind instrument. When a new reed is played, it is stressed in a number of ways and it immediately starts to deteriorate. Saliva is a primary cause of reed deterioration as the digestive nature of it acts to chemically break down the reed tissue. Reeds also deteriorate due to the mechanical stresses of the vibration during play, the interaction of the reed and the tongue and the constant and continuous tightening and loosening of the embouchure.

Technically, in simple terms, what happens is this: The reed vibrates as the musician blows around it and into the instrument. During this process, the reed opens and closes against the mouthpiece acting as somewhat of an air valve. This process of vibration and other mechanical stresses together with the chemical breakdown, all contribute to how long or how little a reed will last.

The only publicly known option to help extend the life of a reed has been the use of a reed cutter. Reed cutters, however, tend to cut unevenly and can cause splitting both of which ruin the reed. Many reed cutters are also difficult to use and expensive to purchase. Furthermore, some require new blades on a regular basis, which are difficult to change and dangerous for the user to handle. Aside from those problems, the major flaw of the reed cutters is the detrimental effect to the cane itself. Cutting the tip of the reed exposes the fibrous tubes in the cane, allowing the glucose a means of escape.

For years, professional jazz musicians have been burning the tips of their reeds to extend the playing life instead of cutting them. Professionals prefer burning over cutting because they have discovered that the reed performs better after it is burned. They just did not know, until now, the scientific aspects involved in the results of the chemical reactions and the mechanical stresses placed on their reeds. All they knew was that burning gave them the results they wanted. They achieved a brighter sound or a more projected sound no matter what style they played and their favorite reeds lasted much longer than their usual life span. By burning the tip, the reed fibers are cauterized with the aid of the glucose. Since the fibers are then sealed, they retain the beneficial qualities of the chemical reaction to the saliva for a longer period of play. This process extends the life of the reed and even gives it a new vitality.

Without a product to assist them, the expedient process that Jazz musicians and other musicians have been practicing for years has worked, but has serious flaws. This process involved burning the tip between two coins. Most critically, with the coin method, there was no way to match the arc of the reed tip, causing a change in the angle of the tip. If not burned precisely, the arc of the tip is altered which changes the dynamics of the reed's playability. Specifically, reeds and mouthpieces are designed to work together and altering the arc of the tip causes a loss of air and a difference in the sound quality from the instrument. Keep in mind that for most professionals, this still made that reed a favorite over the discarded ones in the box. In addition, with no way to pinch the tip between the coins, back burn often occurred to a small portion of the remainder of the reed. The coins also heated up in the process causing slight discomfort to the fingers. However, even with the lack of precision associated with this method, professionals still prefer it to cutting.

Towards this end, woodwind instrument players would benefit from an apparatus and method wherein the tip of a reed is burned whereby the existing arc of the reed tip is maintained, as opposed to cutting the reed to extend the life of the reed.

SUMMARY OF THE INVENTION

One object of the invention is to retain the original precise arc of the tip of the reed and only burn the exact portion of the reed that the musician wants burned, while protecting the all-important fibrous strands of the reed. In addition, this invention safeguards the musician's fingers from the heat associated with burning using the coin method.

Another object of the invention is to extend the life of a reed while achieving a brighter sound or more projected sound. By extending the life of a reed, a cost benefit is also realized since a woodwind instrument player would realize a longer life span on the use of a reed, thus resulting in reducing the need to purchase new reeds.

BRIEF DESCRIPTION OF THE DRAWINGS

The invention will be better understood by referring to the accompanying drawings in which.

DETAILED DESCRIPTION OF THE INVENTION

Figure 1:
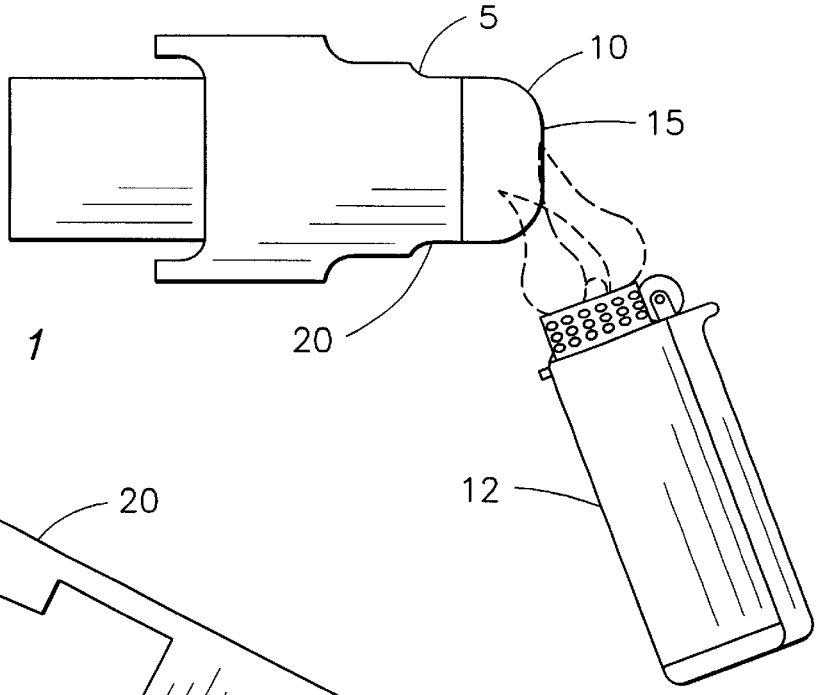
FIG. 1 illustrates a top view of the invention in use.
Figure 2:
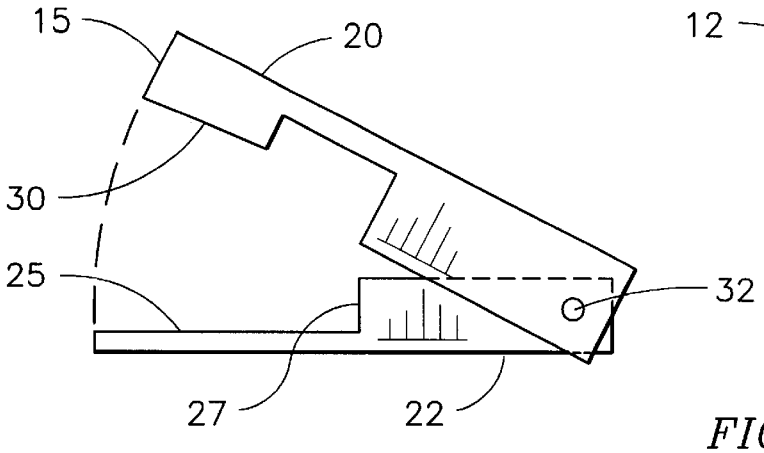
FIG. 2 illustrates a side view of the invention with a top jaw and bottom jaw in an open position.
Figure 3:
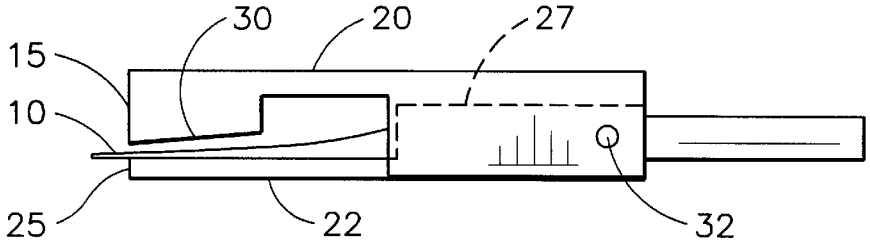
FIG. 3 illustrates a side view of the invention with the top jaw and bottom jaw in a closed position with a reed in place.
Figure 4:
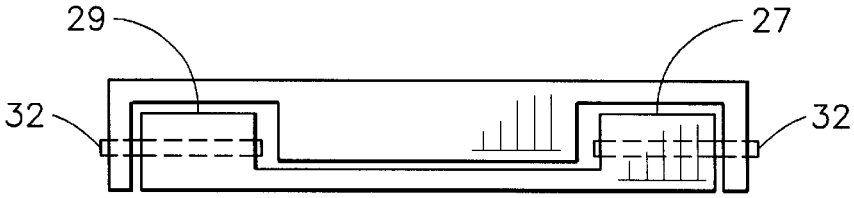
FIG. 4 illustrates a front view of the invention with the top jaw and bottom jaw in a closed position.

Referring to the drawings, FIG. 1 illustrates a top of the invention 5 with a reed 10 inserted between a top jaw and bottom jaw (illustrated in FIGS. 2 and 3). A lighter 12 is disclosed illustrating burning the tip of the reed 10. The tip 15 or front end of the apparatus 5, or the mouth end, is formed in the top jaw 20 and bottom jaw 22 (shown in FIGS. 2–4) whereby the angles or arc at the end of the top and bottom jaws 20, 22 have the same curvilinear shape as the tip of a reed 10 that interacts with a player's tongue or mouth. Except for a small variance in the cut of a reed 10, all reeds for a particular woodwind instrument have the same angles or arc. Thus each embodiment of the invention will have a different tip 15 to provide the specific arc or curvilinear shape for a particular woodwind instrument. In one embodiment, the apparatus 5 is made of a material, such as aluminum, cooper or steel, that acts as a heat sink. In another embodiment, the material can be a non-metallic material such as a ceramic composition that is heat resistant. Thus, in use, a user would grip the lower and upper jaws 20, 22 to hold a reed 10 in place as a flame, such as from a lighter 12, would be applied to the tip of the reed 10 that is exposed and extends beyond the tip 15 of the apparatus 5. The amount of reed tip that is exposed for burning is approximately one-sixteenth of an inch.

FIG. 2 illustrates a side view of the invention with a top jaw 20 and bottom jaw 22 in an open position and FIG. 3 illustrates a side view of the invention with the top jaw 20 and bottom jaw 22 in a closed position. The top jaw 20 and the bottom jaw 22 operate to form a clamp. As illustrated in FIG. 3, the bottom jaw 22 has a planar surface 25 which contacts a bottom side of the reed 10. An edge or track 27 along a side of the bottom jaw 22 extends from the bottom jaw 22 towards the top jaw 20. As better illustrated in FIG. 4, which illustrates a front view of the invention with the top jaw 20 and bottom jaw 22 in a closed position, two edges or tracks 27, 29 exist on opposite sides of the bottom jaw 22. The edges 27, 29 guide the reed 10 so that the reed's curvilinear tip is in line with the apparatus' curvilinear front edge or tip 15. In other embodiment, only one track 27 is provided to guide the reed 10.

The top jaw 20 has a planar surface with a front edge 15 that is curvilinear in shape. The front edge 15 of the top jaw 20 extends downward towards the bottom jaw 22 and, in one embodiment, makes contact with the bottom jaw 22 when the apparatus is closed without a reed 10 in place. The surface of the edge of the top jaw 20 that contacts, or just extends towards, the bottom jaw 22 has an angled surface 30 that parallels the angle of a reed's vamp. The angled surface 30 provides for the top and bottom jaws 20, 22 to uniformly contact the reed 10, thus preventing back burn, or in other words the reed 10 being burnt beyond the amount exposed beyond the apparatus 5. In one embodiment, the top jaw 20 and lower jaw 22 are hinged 32 together. Though not shown, in another embodiment, the top jaw 20 and lower jaw 22 are two independent components that are not continuously physically connected.

In operation, the apparatus 5 is positioned with the top and bottom jaws 20, 22 extended away from each other, or in an open position, and a reed 10 is placed into the apparatus 5 with the back end of the reed 10, or the distant end from the mouth end, inserted into the opened jaws 20, 22. The jaws 20, 22 are then closed and the reed 10 is slid further into the jaws 20, 22 and is further adjusted and aligned. The jaws 20, 22 are then clamped down and a flame is applied to the desired amount of reed 10 extending beyond the apparatus 5.

While the invention has been described in what is presently considered to be the preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. An apparatus for maintaining a woodwind reed, the reed having a mouth end with a thickness tapered at a first angle and a curvilinear edge, the apparatus comprising:

a bottom jaw for receiving the reed, the bottom jaw comprising a planar surface for contacting a bottom surface of the reed, the bottom jaw planar surface comprising an edge formed to parallel the curvilinear edge of the reed;

a top jaw comprising a planar surface for contacting a top surface of the reed with an edge formed to parallel the curvilinear edge of the reed, the top jaw planar surface disposed at a second angle relative to the bottom jaw planar surface corresponding to the first angle; and wherein the bottom jaw planar surface edge and the top jaw planar surface edge are disposed in alignment to define a maintained curvilinear edge on a reed disposed between the bottom jaw and top jaw.

2. The apparatus of claim 1, wherein the first angle and the second angle are equal.

3. The apparatus of claim 2, wherein the second angle is 5 degrees.

4. The apparatus of claim 1 further comprising a track to guide the reed into alignment with the top jaw and bottom jaw.

5. The apparatus of claim 1 further comprising a hinge connecting the top jaw and bottom jaw.

6. The apparatus of claim 1 wherein the apparatus comprises one of the group of aluminum, copper, and steel.

7. The apparatus of claim 1 wherein the apparatus comprises a ceramic material.

8. A method of maintaining a woodwind reed, the reed having a mouth end with a tapered thickness and a curvilinear edge, the method comprising the steps of:

forming a clamping apparatus to have opposed clamping surfaces, the opposed clamping surfaces each having a curvilinear edge parallel to a mouth end edge of a woodwind reed, the clamping surfaces being disposed relative to each other at an angle corresponding to the tapered thickness of the reed;

inserting a reed into the clamping apparatus so that the mouth end of the reed has a portion extending beyond the respective clamping surface edges;

urging the opposed clamping surfaces toward each other to clamp the reed there between; and exposing the extending portion of the reed to heat to burn off the extending portion.

9. The method of claim 8 wherein the inserting step comprises:

having the clamping surfaces in an open position;

placing the reed between the clamping surfaces;

closing the clamping surfaces; and adjusting and aligning the reed within the clamping surfaces.

* * * * *